United States Patent [19]

Kondo et al.

[11] 4,363,149

[45] Dec. 14, 1982

[54] EARTHQUAKE-PROOF SHOE FOR BRIDGES

[76] Inventors: Tokio Kondo, 3-35-1-1003, Hamadayama, Suginami-ku, Tokyo-to; Ryuma Morishige, 270-47, Fuse, Kashiwa-shi, Chiba-ken, both of Japan

[21] Appl. No.: 231,761

[22] Filed: Feb. 5, 1981

[51] Int. Cl.[3] ..... E01D 19/06

[52] U.S. Cl. ..... 14/16.1; 52/167; 248/614

[58] Field of Search ..... 14/16.1; 404/47; 248/614, 615, 632, 633, 507; 52/167, 573

[56] References Cited

U.S. PATENT DOCUMENTS

| | | | |
|---|---|---|---|
| 1,440,498 | 1/1923 | Shurtleff | 248/632 |
| 1,572,574 | 2/1926 | Stromborg | 52/167 X |
| 1,873,009 | 8/1932 | Miller | 248/614 |
| 2,631,800 | 3/1953 | Pinkston | 248/507 X |
| 3,073,065 | 1/1963 | Alderman | 52/167 X |
| 3,349,418 | 10/1967 | Hein | 14/16.1 |
| 3,387,814 | 6/1968 | Fischer | 248/507 |
| 3,889,907 | 6/1975 | De Sourdis | 248/615 X |
| 4,134,561 | 1/1979 | Atkinson | 248/632 |
| 4,188,681 | 2/1980 | Tada | 52/167 X |
| 4,258,516 | 3/1981 | Mori | 52/167 X |

*Primary Examiner*—Nile C. Byers, Jr.

*Attorney, Agent, or Firm*—Price, Heneveld, Huizenga & Cooper

[57] ABSTRACT

A receiving plate for opposite ends of an upper shoe is placed between claws at opposite ends of a lower shoe, rubber packings are detachably provided in the gap spaces between the respective claws and the receiving plate, and the rubber packing consists of an inner plate, a first buffer rubber layer, a middle plate, a second buffer rubber layer and an outer plate. The first buffer rubber layer is made of two flat rubber plates with a plurality of rubber truss plates connected therebetween in a zig-zag form so as to form a large number of vacancies within the first buffer rubber layer, and hence, an impact force caused by an earthquake is absorbed by the rubber packing to prevent the receiving plate or the claws from being destroyed.

8 Claims, 11 Drawing Figures

EARTHQUAKE-PROOF SHOE FOR BRIDGES

The present invention relates to a shoe for supporting a girder of a heavy bridge such as a reinforced concrete bridge, and more particularly to a shoe of such type which can be prevented from being destroyed by an impact force caused by the earthquake.

Figure 10:
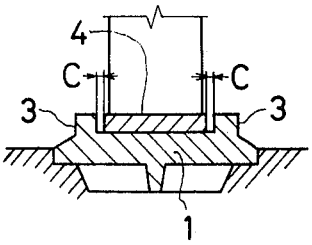

In a shoe made of cast iron or steel to be used for a bridge, as shown in FIG. 10, between claws 3 of a lower shoe 1 and a receiving plate 4 of an upper shoe to be fitted thereto are formed gap clearances C widthwise, and so, if a large force generated by oscillation of the earthquake is exerted upon the upper shoe to which the load of the bridge is always applied, then the claws 3 and the receiving plate 4 collide with each other and are thus subjected to a large impact force, resulting in destruction of the claws or the receiving plate.

It is one object of the present invention to prevent the above-described destruction of the claws of the lower shoe and the receiving plate of the upper shoe.

Figure 11:
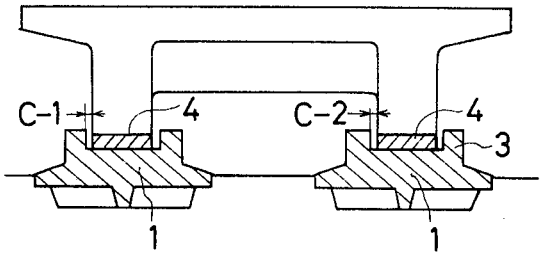

In the case where a bridge floorbeam is supported by two girders, the gap clearances between the respective claws and the receiving plate are normally unequal to each other as shown in FIG. 11, so that the impact force caused by an earthquake is exerted sequentially from a narrower gap clearance C-1 to a broader gap clearance C-2, and thereby the claws 3 and the receiving plate 4 are individually and successively destroyed.

Another object of the present invention is to prevent the above-described individual and successive destruction of the claws and the receiving plate even if the gap clearances between the claws of the lower shoe and the receiving plate of the upper shoe are unequal to each other.

Still another object of the present invention is to prevent destruction of the claws and the receiving plates by increasing the compression strain of a rubber packing.

Yet anothr object of the present invention is to provide a rubber packing of a freely detachable structure for facilitating replacement thereof.

A further object of the present invention is to prevent dust in the air from entering into a rubber packing.

According to the present invention, in order to achieve the aforementioned objects, between claws at opposite ends of a lower shoe is placed a receiving plate for opposite ends of an upper shoe, between the respective claws and the receiving plate are detachably provided rubber packings, each said rubber packing consists of an inner plate, a first buffer rubber layer, a middle plate, a second buffer rubber layer and an outer plate as superposed on each other, and said first buffer rubber layer is made of two flat rubber plates with a plurality of rubber truss plates connected therebetween in a zig-zag form so as to form a large number of vacancies within the first buffer rubber plate.

Figure 1:
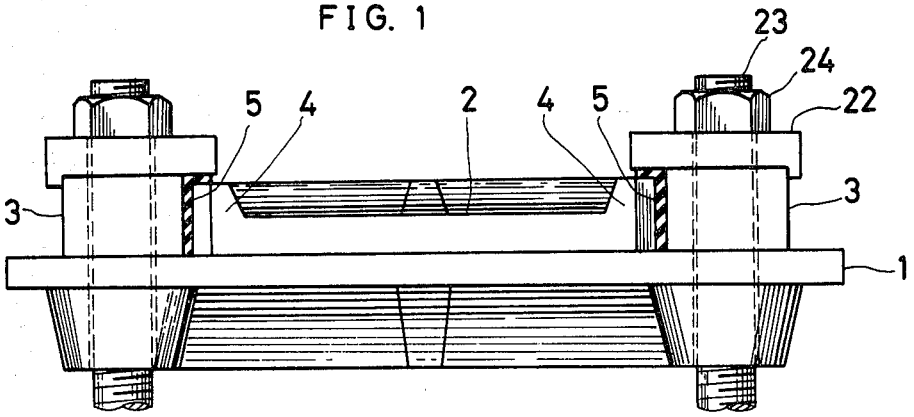
Figure 2:
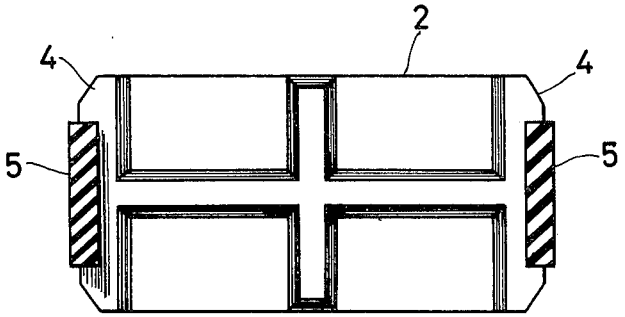
Figure 3:
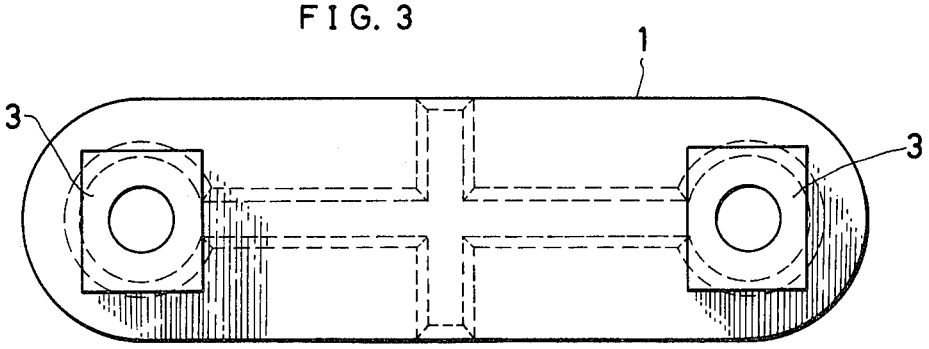
Figure 4:
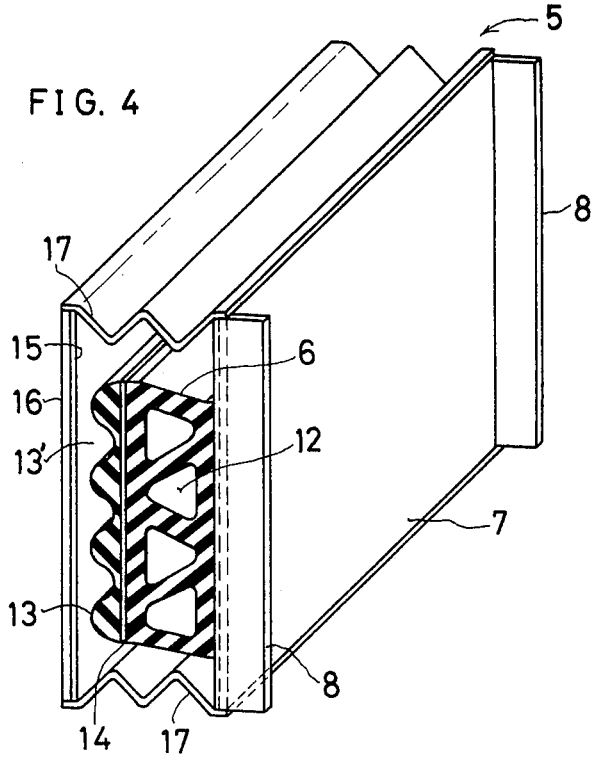
Figure 5:
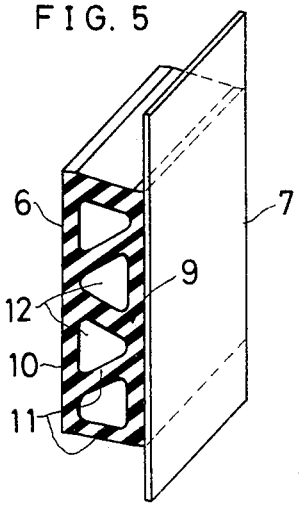
Figure 6:
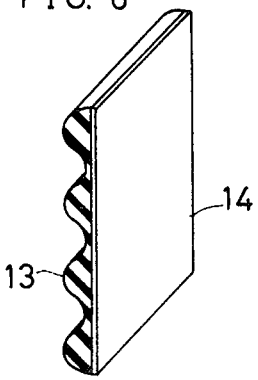
Figure 7:
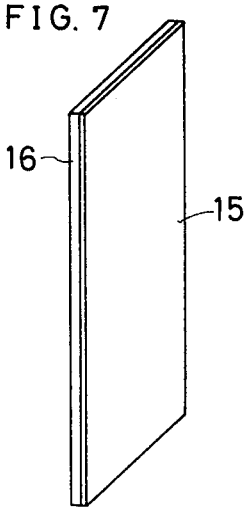
Figure 9:
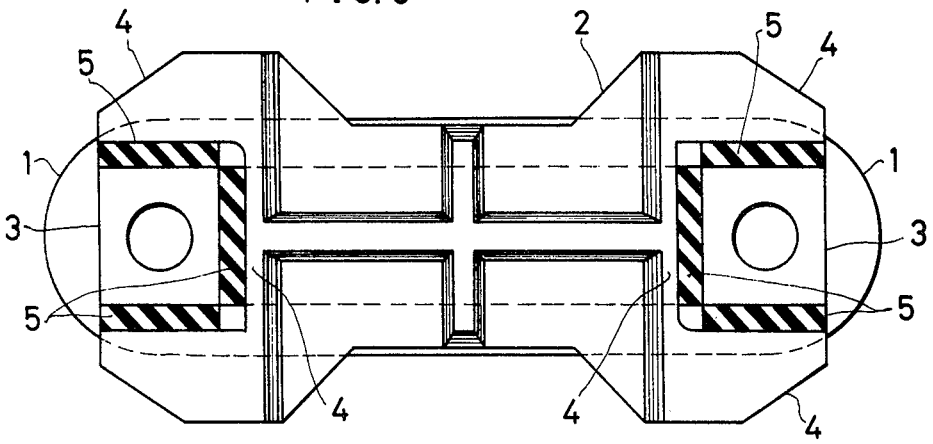
Figure 8:
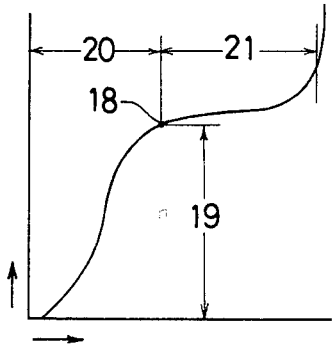

The above-mentioned and other features and objects of the present invention will become more apparent by reference to the following description of preferred embodiments thereof taken in conjunction with the accompanying drawings, wherein:

FIG. 1 is a front view showing one preferred embodiment of the present invention, FIG. 2 is a plan view of an upper shoe in the preferred embodiment shown in FIG. 1, FIG. 3 is a plan view of a low shoe in the same embodiment, FIG. 4 is a perspective view showing an assembly of a rubber packing, FIG. 5 is a perspective view of a first buffer rubber layer, FIG. 6 is a perspective view of a second buffer rubber layer, FIG. 7 is a perspective view of an outer plate with a slide member sticked thereon, FIG. 8 is a diagram showing an elastic property of a rubber packing, FIG. 9 is a plan view showing another preferred embodiment of the present invention, FIG. 10 is a front view showing gap clearances between claws of a lower shoe and a receiving plate of an upper shoe, and FIG. 11 is a front view showing inequality between respective gap clearances between claws and receiving plate in the case where two girders are present.

Referring now to FIGS. 1 to 3, on a lower shoe 1 is placed an upper shoe 2 between claws 3 at the opposite ends of the lower shoe 1, and between the respective claws 3 and a receiving plate 4 of the upper shoe 2 are inserted rubber packings 5 which are detachably mounted. In FIG. 1, reference numeral 22 designates a rubber packing holder, numeral 23 designates a bolt and numeral 24 designates a nut.

Before explaining the details of the rubber packing 5, component parts thereof will be described individually. With reference to FIG. 5, a first buffer rubber layer 6 generally forms a parallelpiped, and it is adhered to an inner plate 7. The first buffer rubber layer 6 is made of two flat rubber plates 9 and 10 with a plurality of rubber truss plates 11 connected therebetween in a zig-zag form so as to form a large number of vacancies 12 within the first buffer rubber layer 6.

With reference to FIG. 6, the second buffer rubber layer 13 has a large number of protrusions on its outside in a corrugated form and a flat surface on its inside, and it is adhered to a middle plate 14.

With reference to FIG. 7, an outer plate 15 has a slide member 16 such as a Teflon sheet adhered thereon.

In FIG. 4, a rubber packing 5 consists of an inner plate 7, a first buffer rubber layer 6, a middle plate 14, a second buffer rubber layer 13 and an outer plate 15 as superposed on each other, so that vacancies 12 may be held within the first buffer rubber layer 6 and vacancies 13' may be held in the valleys between the protrusions of the second buffer rubber layer 13.

Between the upper edges and lower edges of the inner plate 7 and the outer plate 15 are respectively provided flexible corrugated covers 17, mount plates 8 are provided along the opposite side edges of the inner plate 7 so that the claw 3 of the lower shoe 1 may be pinched by these two mount plates 8, and thereby displacement of the rubber packing can be prevented.

Since the rubber packing 5 is made of rubber, it has a large elasticity, and moreover, because of the existence of elastic truss plates 11 and vacancies 12 within the rubber packing, the elasticity is especially large. Qualitatively explaining the elastic property of the rubber packing 5 with reference to FIG. 5, the ordinate of the diagram in FIG. 8 represents a compression force exerted upon a unit area of the rubber packing 5 in the direction of its thickness, and the abscissa of the same represents a compression strain. The interval indicated by numeral 20 in FIG. 8 represents the elastic property mainly in response to an impact force, whereas the interval indicated by numeral 21 represents the elastic property mainly corresponding to the unequality of the gap clearances (C-1 and C-2) upon installation of the respective shoes. A point indicated by numeral 18 on the curve represents the time point when a compression force is to be generated in the direction of thickness of the rubber packing 5 in view of its design. The compression force per unit area at this time point is indicated by numeral 19, and the magnitude of strain is indicated by numeral 20.

Explaining the case where the rubber packing 5 is not provided, as shown in FIG. 10 some gap clearances C are provided between the respective claws 3 and the receiving plate 4 of the upper shoe 2 fitting to these claws due to the necessity for working upon building a bridge girder. Since these claws 3 and receiving plate 4 are made of hard steel or cast iron and are hardly deformed in shape, if a large dynamic force caused by an acceleration such as the earthquake oscillation is exerted thereupon, then the claws 3 and the receiving plate 4 will collide with each other, and as a result they will be destroyed.

According to the present invention, since the above-described rubber packings 5 are inserted between the respective claws 3 of the lower shoe 1 and the receiving plate 4 of the upper shoe 2, a considerable portion of the large dynamic horizontal force caused by the acceleration of the earthquake can be absorbed by the elastic truss plates 11 and the vacancies 12 in the rubber packing 5 at the strain value indicated by numerals 20 in FIG. 8, and furthermore, the horizontal force caused by inequality of the gap clearances C-1 and C-2 upon installation of the shoes as shown in FIG. 11 can be absorbed by the strain indicated at 21 in FIG. 8, so that the horizontal force can be distributed over all the shoes.

In another preferred embodiment illustrated in FIG. 9, an upper shoe 2 is placed on a lower shoe 1 between claws 3 at the opposite ends of the lower shoe 1, and rubber packings 5 are provided along three edges of the receiving plate 4 of the upper shoes 2 surrounding the respective claws 3. In this modified embodiment, the mount plate 8 associated with the rubber packing 5 in FIG. 4 could be omitted. The rubber packings 5 provided along the three edges are brought into contact with the claw 3 of the lower shoe 1. Thereby, the modified structure can absorb impact forces in two directions.

What is claimed is:

1. An earthquake oscillation absorbing shoe including: a lower shoe member having a pair of upstanding claws, one adjacent each end of said central portion; an upper shoe member seated on said lower shoe member between said claws, the ends of said upper shoe member being spaced from each of said claws to form a gap therebetween; a pair of packing elements, one seated in each of said gaps and contacting both said upper shoe member and the adjacent one of said claws; said packing elements each having a resilient rubber body characterized by a plurality of truss-like webs separated by openings to absorb relative oscillatory motion between said upper and lower shoes in the direction of the plane of the top surface of the lower shoe such as would be generated by an earthquake.

2. An earthquake oscillation absorbing shoe as described in claim 1 further including a rubber pad having a pair of faces, one face being flat and the other undulating, said flat face being directed toward said rubber body.

3. An earthquake oscillation absorbing shoe as described in claim 2 further including an inner plate adhered to said one face of said rubber pad and seated against said rubber body.

4. An earthquake oscillation absorbing shoe as described in claim 3 further including an outer plate having a low friction surface, said surface being seated against said undulating surface and compressible side members connecting said inner and outer plates.

5. An earthquake oscillation absorbing shoe as described in claim 1 further including each of said packing elements having an inner plate and an outer plate, with said rubber body therebetween.

6. An earthquake oscillation absorbing shoe including: a lower shoe member having a pair of upstanding claws, one adjacent each end of said central portion; an upper shoe member seated on said lower shoe member between said claws, the ends of said upper shoe member each having a recess opening through the end thereof and seating around three sides of the adjacent one of said claws and being spaced from each of the sides of said claws to form a gap therebetween; a packing element seated in each of said gaps and contacting both said upper shoe member and the adjacent side of one of said claws; said packing elements each having a resilient rubber body characterized by a plurality of truss-like webs separated by openings to absorb relative oscillatory motion between said upper and lower shoes such as would be generated by an earthquake.

7. An earthquake oscillation absorbing shoe as described in claim 6 further characterized in that each of said claws and recesses is rectilinear.

8. An earthquake resistant support for a structure comprising an earthquake oscillation absorbing shoe as described in claim 6 wherein means are provided for securing said lower shoe member to the ground and said structure resting on and supported by said upper shoe and said packing elements absorbing relative movement parallel to the ground between said shoe members and increasing the time interval during which load transmission is increased in each oscillation.

* * * * *

UNITED STATES PATENT AND TRADEMARK OFFICE

CERTIFICATE OF CORRECTION

PATENT NO. : 4 363 149

DATED : December 14, 1982

INVENTOR(S) : Tokio Kondo et al.

It is certified that error appears in the above-identified patent and that said Letters Patent is hereby corrected as shown below:

Column 1, line 40:

"anothr" should be --another--

Column 3, line 29:

After "20" add --and 21--

Signed and Sealed this

*Twenty-ninth* Day of *March 1983*

[SEAL]

*Attest:*

GERALD J. MOSSINGHOFF

*Attesting Officer*

*Commissioner of Patents and Trademarks*